US011118781B2

(12) United States Patent
Brückner et al.

(10) Patent No.: US 11,118,781 B2
(45) Date of Patent: Sep. 14, 2021

(54) VERTICAL HEAT RECOVERY STEAM GENERATOR

(71) Applicant: Siemens Aktiengesellschaft, Munich (DE)

(72) Inventors: Jan Brückner, Uttenreuth (DE); Frank Thomas, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 221 days.

(21) Appl. No.: 16/314,088

(22) PCT Filed: Jul. 19, 2016

(86) PCT No.: PCT/EP2016/067169
§ 371 (c)(1),
(2) Date: Dec. 28, 2018

(87) PCT Pub. No.: WO2018/014941
PCT Pub. Date: Jan. 25, 2018

(65) Prior Publication Data

US 2019/0170344 A1 Jun. 6, 2019

(51) Int. Cl.
*F22D 1/00* (2006.01)
*F22D 11/00* (2006.01)
(Continued)

(52) U.S. Cl.
CPC ..... *F22D 1/003* (2013.01); *F22B 21/00* (2013.01); *F22B 29/06* (2013.01); *F22B 37/62* (2013.01); *F22D 11/00* (2013.01)

(58) Field of Classification Search
CPC ..... F22D 1/003; F22D 11/00; F01K 17/00; F01K 17/06; F01K 23/106; F01K 12/108;
(Continued)

(56) References Cited

U.S. PATENT DOCUMENTS 5,293,842 A * 3/1994 Loesel ..... F22D 1/003 122/1 C
5,369,950 A 12/1994 Bruckner et al.
(Continued)

FOREIGN PATENT DOCUMENTS

CA 2301524 A1 3/1999
CN 1295660 A 5/2001
(Continued)

OTHER PUBLICATIONS

Zhang Weiwei: "Simulation and Dynamic Analysis of Thermal System of Thermal Power Plant"; China Excellent Master's Thesis Full-text Database Engineering Technology Series II; No.7; C042-644; published on Jul. 15, 2012; English machine translation attached.

(Continued)

*Primary Examiner* — Steven B McAllister
*Assistant Examiner* — Charles R Brawner

(57) ABSTRACT

A vertical heat recovery steam generator, the low-pressure stages of which are designed as a once-through system, having a condensate preheater with at least one condensate preheater heating surface, through which a flow medium flows and which is disposed in a hot gas channel through which hot gas flows, a low-pressure preheater with at least one low-pressure preheater heating surface through which the flow medium flows and which is disposed in the hot gas channel, and a low-pressure evaporator with at least one low-pressure evaporator heating surface through which the flow medium flows and which is disposed in the hot gas channel. The flow medium flows successively through the at least one low-pressure preheater heating surface and the at least one low-pressure evaporator heating surface in one pass and without additional pressure compensation.

5 Claims, 4 Drawing Sheets

(51) Int. Cl.
*F22B 21/00* (2006.01)
*F22B 29/06* (2006.01)
*F22B 37/62* (2006.01)

(58) Field of Classification Search
CPC ..... F01K 23/11; F22B 21/00; F22B 29/06; F22B 37/62
See application file for complete search history.

(56) References Cited

U.S. PATENT DOCUMENTS

| | | | | |
|---|---|---|---|---|
| 5,776,413 | A | 7/1998 | Kamberger et al. | |
| 5,924,389 | A | 7/1999 | Palkes et al. | |
| 6,041,588 | A | 3/2000 | Bruckner et al. | |
| 6,089,013 | A * | 7/2000 | Bruckner | B01D 19/0047 60/39.182 |
| 6,343,570 | B1 * | 2/2002 | Schmid | F01K 23/106 122/7 R |
| 2001/0007190 | A1 * | 7/2001 | Schmid | F01K 23/106 60/39.182 |
| 2001/0008067 | A1 * | 7/2001 | Liebig | F01K 23/106 60/772 |
| 2004/0187688 | A1 * | 9/2004 | Liebig | B01D 19/0047 95/251 |
| 2009/0090111 | A1 * | 4/2009 | Tomlinson | F01K 23/106 60/783 |
| 2011/0113786 | A1 * | 5/2011 | Rancruel | F01K 25/08 60/772 |
| 2013/0000272 | A1 * | 1/2013 | Gulen | F02C 7/224 60/39.182 |
| 2016/0245127 | A1 * | 8/2016 | Kloeckener | F22D 1/16 |
| 2017/0268384 | A1 * | 9/2017 | Couzzicarneiro | F01K 17/025 |

FOREIGN PATENT DOCUMENTS

| | | | | |
|---|---|---|---|---|
| CN | 101776399 | A | 7/2010 | |
| DE | 19736886 | A1 * | 3/1999 | F01K 23/106 |
| EP | 0582898 | A1 | 2/1994 | |
| EP | 0777036 | A1 | 6/1997 | |
| JP | S5795121 | A | 6/1982 | |
| JP | S59-003101 | U1 | 1/1984 | |
| JP | H06241005 | A | 8/1994 | |
| JP | 2001514353 | A | 9/2001 | |
| JP | 2009063205 | A | 3/2009 | |
| WO | 9500747 | A1 | 1/1995 | |
| WO | 9636792 | A1 | 11/1996 | |
| WO | 2015039831 | A2 | 3/2015 | |

OTHER PUBLICATIONS

PCT International Search Report and Written Opinion of International Searching Authority dated Mar. 15, 2017 corresponding to PCT International Application No. PCT /E P201 6/067169 filed Jul. 19, 2016.

* cited by examiner

VERTICAL HEAT RECOVERY STEAM GENERATOR

CROSS REFERENCE TO RELATED APPLICATIONS

This application is the US National Stage of International Application No. PCT/EP2016/067169 filed Jul. 19, 2016, incorporated by reference herein in its entirety.

FIELD OF INVENTION

The invention relates to a vertical heat recovery steam generator.

BACKGROUND OF INVENTION

Heat recovery steam generators are nowadays used in many power plants to boost the efficiency of the plant. Apart from the conventional horizontal boiler design, current refinements are aimed at developing an efficient vertical boiler. One consideration is to embody all three pressure stages as a once-through system in order in this way to be able to dispense with large-volume and heavy cylinders, even in the medium- and low-pressure range, in comparison with the current horizontal boiler design. Moreover, this would also enable the entire steel structure of the boiler to be made slimmer and less expensive.

Thermohydraulic studies, especially those on once-through low-pressure evaporators, have shown that stable flow through the evaporators over the entire load range cannot be achieved with the heating surface configuration for condensate and feed water preheating which is normally used at the present time, in which the preheating of the feed water for the low-pressure system takes place exclusively in the condensate preheater.

SUMMARY OF INVENTION

It is an object of the invention to provide an improved vertical heat recovery steam generator.

This object is achieved with the vertical heat recovery steam generator having the features of the independent claim. Further advantageous embodiments can be found in the dependent claims.

It has been found that stable flow through the evaporator heating surfaces can be achieved, even at low pressures in the low-pressure section, if the tubing of the preheater and of the evaporator are designed for one-pass operation without additional pressure compensation and if a sufficiently high pressure drop is produced in the region of the preheater. Normally, this can be achieved by providing the tubes of this heating surface with small inside diameters in the inlet region, in which only low-temperature medium flows in the entire load range. Initial estimates have also shown that this required restrictor pressure drop, which is required for stable flow through the low-pressure evaporator, could be achieved by a combination circuit of this kind. In contrast to currently known solutions, however, an additional low-pressure preheater heating surface is required for this purpose. However, if the supply to the low-pressure evaporator is no longer provided by the flow medium from the condensate preheater but is implemented by a dedicated pre-heating circuit, it is necessary, as with the condensate preheater, to ensure that the temperature of the flow medium does not fall below a system-relevant design temperature at any point within the tubes of the low-pressure preheater. Only in this way is it possible to ensure that the tubes do not suffer any corrosion during operation.

According to the invention, it is therefore envisaged that the vertical heat recovery steam generator, the low-pressure stages of which are designed as a once-through system, comprises a condensate preheater with at least one condensate preheater heating surface, through which a flow medium flows and which is disposed in a hot gas channel, through which hot gas flows, a low-pressure preheater with at least one low-pressure preheater heating surface, through which the flow medium flows and which is disposed in the hot gas channel, and a low-pressure evaporator with at least one low-pressure evaporator heating surface, through which the flow medium flows and which is disposed in the hot gas channel, wherein the flow medium flows successively through the at least one low-pressure evaporator heating surface in one pass and without additional pressure compensation. In this case, a first of the at least one low-pressure preheater heating surfaces in the hot gas channel is advantageously disposed after a first of the at least one condensate preheater heating surfaces in the hot gas direction. As an alternative, however, it would also be possible for the low-pressure and the condensate preheater heating surfaces to be disposed largely in the same region (e.g. staggered).

As compared with known solutions, in which the preheating of the feed water—referred to as the flow medium flowing through the heating surfaces of the low-pressure system—takes place only in the condensate preheater, a separate low-pressure preheater (LP economizer) having corresponding low-pressure preheater heating surfaces is provided in the present invention. For this purpose, a two-part arrangement of these heating surfaces, on the one hand after the condensate preheater at the flue gas channel outlet and, on the other hand, at a point between the heating surfaces of a two-part condensate preheater which is suitable from a thermodynamic point of view, is advantageously selected. Arranging the low-pressure preheater in the coldest section of the flue gas channel ensures that evaporation of the flow medium does not take place in the tubes provided there with small inside diameters, making it possible to achieve static and dynamic flow stability. The arrangement of the second low-pressure preheater heating surface at a suitable point between the two condensate preheater heating surfaces makes it possible to ensure the required preheating of the feed water for the low-pressure system.

In an advantageous embodiment according to the invention, an arrangement is provided which satisfies the requirements, namely to ensure a minimum temperature of the flow medium at the inlet of the low-pressure preheater, without additional economic or operational disadvantages occurring at the same time. To achieve this, the flow medium is removed at the inlet of the condensate preheater, i.e. ahead of the first condensate preheater heating surface, in order to feed the low-pressure system.

In an advantageous manner, this removal is accomplished by way of a branch and a corresponding control valve after or downstream of the point of insertion of the condensate preheater recirculation mass flow, which controls the inlet temperature of the flow medium into the condensate preheater. This ensures that the temperature of the flow medium at the inlet of the first low-pressure preheater heating surface is the same as at the inlet of the first condenser preheater heating surface. Both systems, i.e. the condenser preheater and the low-pressure stage are thus subject to the same inlet temperature. This ensures that a minimum temperature of the flow medium required from the point of view of corrosion is not undershot, even in the low-pressure system.

With an embodiment, it is possible to ensure, without additional equipment, that the flow medium supplied at the inlet of the low-pressure preheater has virtually the same temperature as at the inlet of the condensate preheater. There is no need for dedicated temperature control of the flow medium at the inlet of the low-pressure preheater. Control of the fluid temperature at the inlet of the condensate preheater, which is usually provided by the additional recirculation circuit of the condensate preheater, thus also simultaneously ensures the inlet temperature of the flow medium required from the point of view of corrosion at the low-pressure preheater. Particularly during oil operation of the gas turbines, an elevated temperature of the flow medium is thus also ensured in the inlet region of the low-pressure preheater.

In another embodiment according to the invention, an independent recirculation circuit is integrated into the low-pressure system, comprising a low-pressure preheater and a low-pressure evaporator, and furthermore overfeeds the low-pressure evaporator. The water which has not yet been evaporated and has been separated from the steam in a water/steam separator and is at boiling temperature is then returned to the inlet of the low-pressure preheater by means of a low-pressure circulating pump and added to the cold feed water. By appropriate choice of the level of overfeeding of the low-pressure evaporator and the associated recirculation quantity it is possible to suitably set the required minimum temperature of the flow medium at the inlet of the first low-pressure preheater heating surface. One advantage of this variant embodiment is that, by virtue of the overfeeding, there is a relatively high evaporator throughput, which, in turn, has a positive effect on the stability properties of the flow in the low-pressure evaporator. However, this embodiment has the disadvantage, when compared with the particularly advantageous variant embodiment, that in this case additional equipment (such as a circulating pump, control valves etc.) is required for the recirculation circuit. Moreover, it is not possible with this embodiment to achieve superheating of the flow medium at the outlet of the low-pressure evaporator at any time over the entire operating range since the low-pressure evaporator fundamentally has to be operated in the wet mode with a level of overfeeding required for the setting of the minimum temperature of the flow medium at the inlet of the low-pressure preheater.

BRIEF DESCRIPTION OF THE DRAWINGS

The invention will now be explained by way of example with reference to the following figures. In the drawing.

DETAILED DESCRIPTION OF INVENTION

Figure 1:
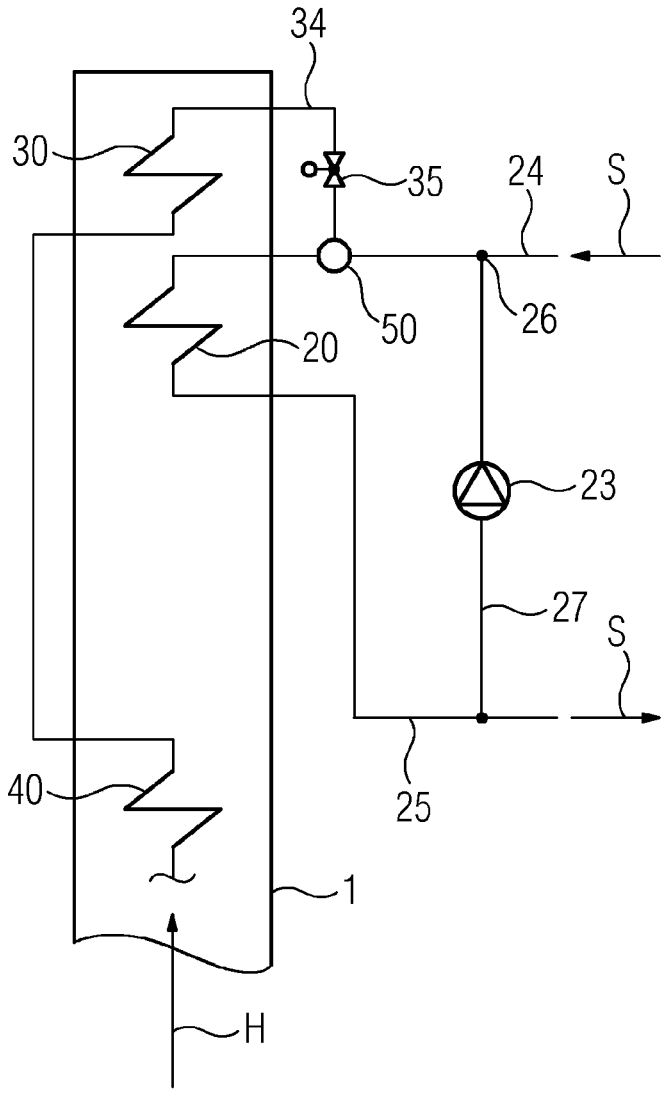
FIG. 1 shows schematically an illustrative embodiment according to the invention of the low-pressure stages of a vertical heat recovery steam generator.

FIG. 1 shows schematically the variant embodiment of a once-through low-pressure system of a vertical heat recovery steam generator, this variant being the advantageous one for ensuring flow stability. Said generator comprises a condensate preheater with a condensate preheater heating surface 20, through which a flow medium (S) flows and which is disposed in a hot gas channel 1, through which hot gas H flows, a low-pressure preheater with a low-pressure preheater heating surface 30, through which the flow medium S flows and which is disposed in the hot gas channel 1, and a low-pressure evaporator with a low-pressure evaporator heating surface 40, through which the flow medium S flows and which is disposed in the hot gas channel 1. Here, the low-pressure preheater heating surface 30 and the low-pressure evaporator heating surface 40 are designed in such a way that the flow medium S flows successively through them in one pass and without additional pressure compensation. Moreover, the low-pressure preheater heating surface 30 in the hot gas channel 1 is disposed after the condensate preheater heating surface 20 in the hot gas direction.

Moreover, a branch 50 for feeding the low-pressure preheater with some of the flow medium S is provided in a first feed line 24 of the flow medium S toward the condensate preheater. Furthermore, a control valve 35 is provided after the branch 50, in a second feed line 34 toward the low-pressure preheater, said valve controlling the quantity of flow medium S diverted to the low-pressure preheater. Moreover, a circulating pump 23 is provided here for the condensate preheater, said pump returning the flow medium heated in the condensate preheater heating surfaces to the first feed line 24 via lines 25 and 27 and a first connection point 26, wherein the first connection point 26 is disposed in the first feed line 24, ahead of the branch 50.

Figure 2:
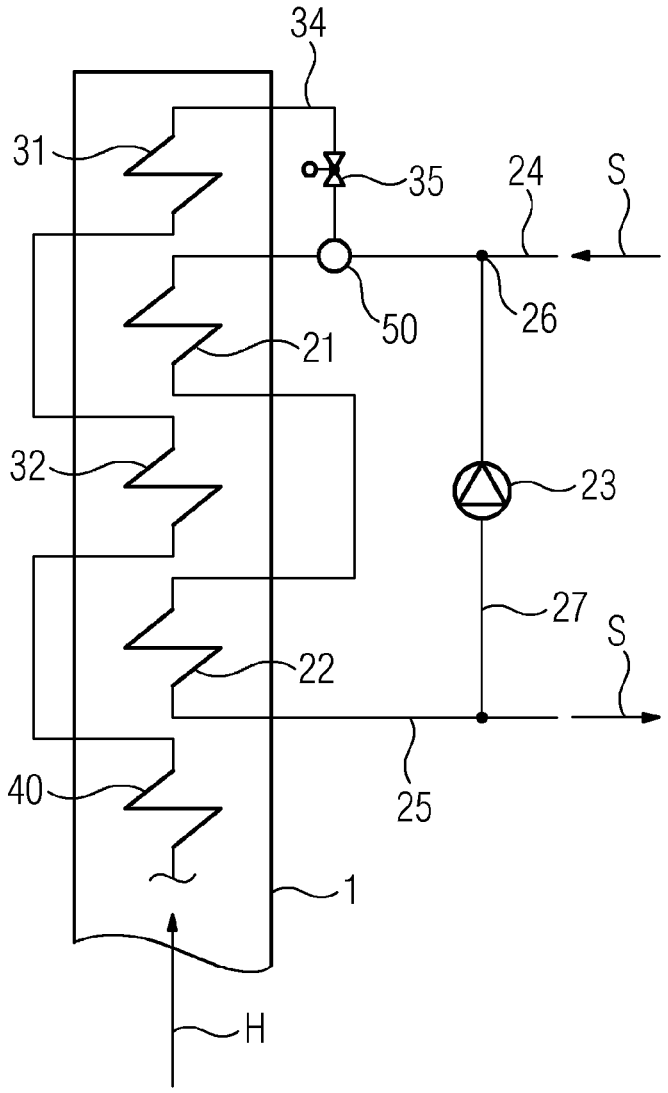
FIG. 2 shows schematically an illustrative embodiment according to the invention of a vertical heat recovery steam generator with subdivided heating surfaces.

FIG. 2 shows a development of the above-described embodiment of a vertical heat recovery steam generator but with a condensate preheater comprising two condensate preheater heating surfaces 21 and 22, through which the flow medium S flows successively and which are disposed in a spatially separate manner in the hot gas channel 1. Moreover, in this case the heat recovery steam generator has a low-pressure preheater with two low-pressure preheater heating surfaces 31 and 32, through which the flow medium S flows successively and which are disposed in a spatially separate manner in the hot gas channel 1, and has a low-pressure evaporator with at least one low-pressure evaporator heating surface 40, which is disposed in the hot gas channel 1 and through which the flow medium S flows after the low-pressure preheater heating surfaces. According to the invention, provision is now made for the first low-pressure preheater heating surface 31, through which flow medium S flows, to be disposed in the hot gas channel 1 after the first condensate preheater heating surface 21 in the hot gas direction and for the second low-pressure preheater heating surface 32, through which the flow medium S subsequently flows, to be disposed between the first and the second condensate preheater heating surface 21 and 22 in the hot gas direction. Furthermore, a branch 50 for feeding the low-pressure preheater with some of the flow medium S is provided in a feed line 24 of the flow medium S to the condensate preheater, wherein the quantity of flow medium S diverted is controlled by a control valve 35. By virtue of the fact that a circulating pump 23 is furthermore provided for the condensate preheater in order to return the flow medium heated in the condensate preheater heating surfaces to the feed line 24 via a line 27 and a connection point 26 and that the branch 50 is disposed downstream of the connection point 26, a flow medium with virtually the same temperature level is now available to both systems.

Figure 3:
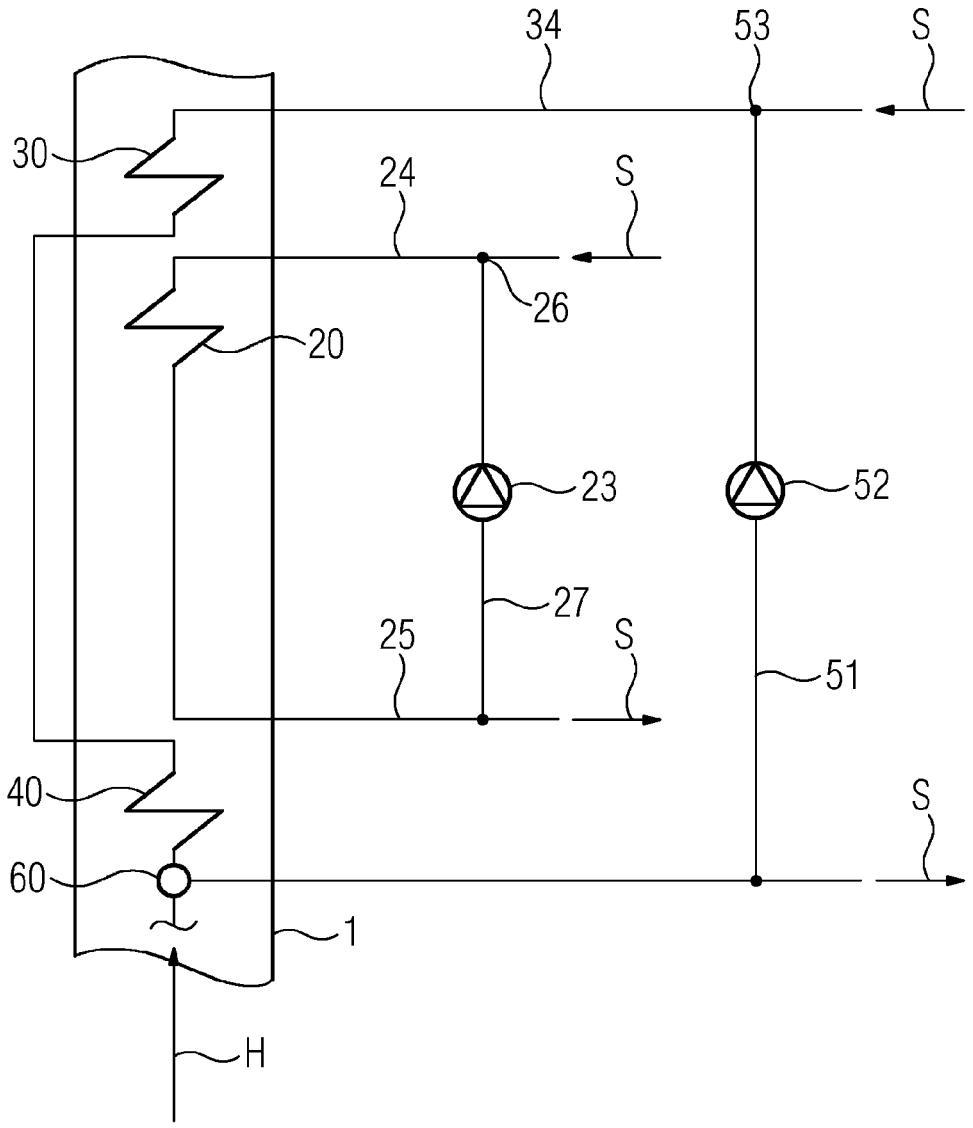
FIGS. 3-4 show schematically two further illustrative embodiments according to the invention.
Figure 4:
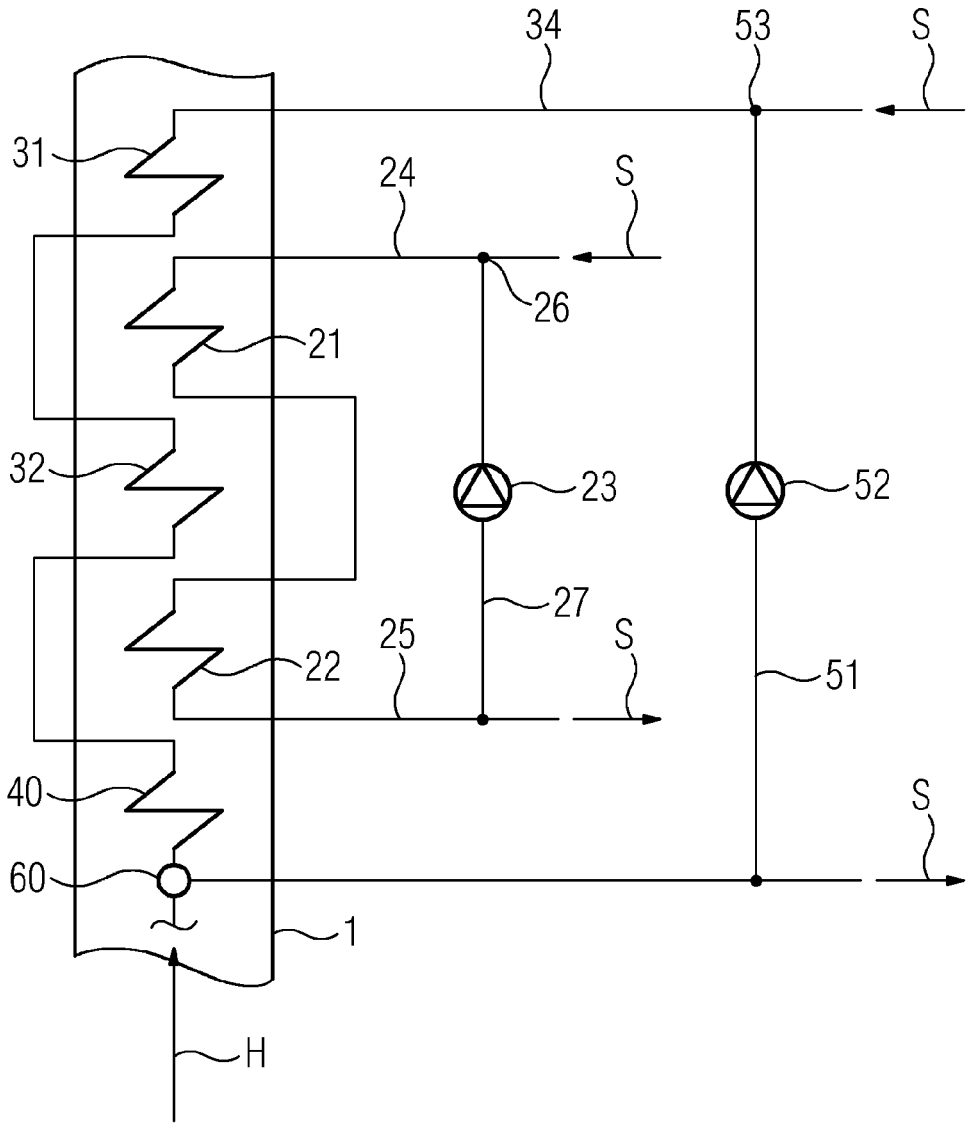

FIG. 3 and FIG. 4 show an alternative embodiment of a vertical heat recovery steam generator. In contrast to the embodiment illustrated in FIG. 1 and FIG. 2, a low-pressure circulating pump 52 is also provided here for the low-pressure preheater and low-pressure evaporator circuit in order to return the unevaporated flow medium S flowing through the low-pressure preheater and evaporator heating surfaces to the second feed line 34 via a water/steam separator 60, a return line 51 and a connection point 53. With the aid of suitable evaporator overfeeding, the circulated mass flow passed via the low-pressure circulating pump 52 and the return line 51 can be set precisely to ensure that the desired temperature of the flow medium S is achieved at the inlet to the first low-pressure preheater heating surface.

The invention claimed is:

1. A vertical heat recovery steam generator, a stage of which is designed as a once-through system, comprising:

a condensate preheater with at least one condensate preheater heating surface, through which a flow medium flows and which is disposed in a hot gas channel, through which hot gas flows, a preheater with at least one preheater heating surface, through which the flow medium flows and which is disposed in the hot gas channel, a evaporator with at least one evaporator heating surface, through which the flow medium flows and which is disposed in the hot gas channel, wherein the flow medium flows successively through the at least one preheater heating surface and the at least one evaporator heating surface in one pass and without a control valve or a circulating pump located between the preheater and evaporator providing additional pressure compensation and wherein a first of the at least one preheater heating surfaces in the hot gas channel is disposed in a region of a hot gas channel outlet and after a first of the at least one condensate preheater heating surfaces in the hot gas direction or the first of the at least one preheater heating surfaces in the hot gas channel is disposed adjacent to the first of the at least one condensate preheater heating surfaces along the hot gas channel, wherein the condensate preheater comprises two condensate preheater heating surfaces, through which the flow medium flows successively and which are disposed in a spatially separate manner in the hot gas channel, and wherein the preheater comprises two preheater heating surfaces, through which the flow medium flows successively and which are disposed in a spatially separate manner in the hot gas channel, wherein a first preheater heating surface, through which the flow medium flows, is disposed in the hot gas channel after a first condensate preheater heating surface in a hot gas direction, and a second preheater heating surface, through which the flow medium subsequently flows, is disposed between the first condensate preheater heating surface and a second condensate preheater heating surface in the hot gas direction.

2. The vertical heat recovery steam generator as claimed in claim 1, further comprising:

a branch for feeding the preheater with some of the flow medium in a first feed line of the flow medium toward the condensate preheater.

3. The vertical heat recovery steam generator as claimed in claim 2, further comprising:

a control valve after the branch, in a second feed line toward the preheater, said control valve controlling a quantity of flow medium diverted to the preheater.

4. The vertical heat recovery steam generator as claimed in claim 2, further comprising:

a circulating pump for the condensate preheater, said circulating pump returning the flow medium heated in the condensate preheater heating surfaces to the first feed line via lines and a first connection point, wherein the first connection point is disposed in the first feed line, ahead of the branch.

5. The vertical heat recovery steam generator as claimed in claim 1, further comprising:

a circulating pump for the preheater and the evaporator, said pump returning unevaporated flow medium flowing through the preheater and the evaporator heating surfaces, via a water/steam separator, a return line and a second connection point, to a second feed line toward the preheater.

* * * * *